US008418263B2

(12) United States Patent
McVan

(10) Patent No.: US 8,418,263 B2
(45) Date of Patent: Apr. 16, 2013

(54) BOXING EXERCISE DEVICE

(75) Inventor: Jesse McVan, Wellington, FL (US)

(73) Assignee: Perfect Pecs, LLC, Wellington, FL (US)

( * ) Notice: Subject to any disclaimer, the term of this patent is extended or adjusted under 35 U.S.C. 154(b) by 203 days.

(21) Appl. No.: 12/589,356

(22) Filed: Oct. 21, 2009

(65) Prior Publication Data

US 2011/0088131 A1 Apr. 21, 2011

(51) Int. Cl.
*A41D 13/08* (2006.01)

(52) U.S. Cl.
USPC ..... 2/18; 273/330; 473/424

(58) Field of Classification Search ..... 2/18, 16, 2/159, 161.1; 273/335, 330; 473/426, 424, 473/578, 576
See application file for complete search history.

(56) References Cited

U.S. PATENT DOCUMENTS 500,049 A * 6/1893 Bennett ..... 2/18
618,970 A * 2/1899 Wood ..... 2/18
705,915 A * 7/1902 Gamble ..... 2/18
729,473 A * 5/1903 Wilson ..... 473/576
768,733 A * 8/1904 Burtt ..... 2/18
1,411,451 A * 4/1922 Mygind ..... 473/576
1,453,715 A * 5/1923 Levinson ..... 2/18
1,753,310 A * 4/1930 Costello ..... 473/424
2,142,068 A * 12/1938 Berger ..... 273/330
2,147,157 A * 2/1939 Goertz ..... 273/330
2,208,359 A * 7/1940 Driscoll ..... 273/330
2,269,633 A * 1/1942 Merle ..... 473/518
2,446,758 A * 8/1948 Golomb ..... 2/18
3,153,537 A * 10/1964 Lewis ..... 273/412
3,229,979 A * 1/1966 Smoak, Jr. ..... 273/330
3,731,927 A * 5/1973 Rocco, Jr. ..... 473/424
3,855,633 A * 12/1974 Rhee ..... 2/18
3,903,546 A * 9/1975 Rhee ..... 2/16
4,018,441 A * 4/1977 Greenberg ..... 482/82
4,417,359 A * 11/1983 Johnson ..... 2/16
4,434,980 A * 3/1984 Babineaux ..... 482/86
4,603,439 A * 8/1986 Golomb ..... 2/18
4,753,442 A * 6/1988 Bland ..... 473/424
4,836,555 A * 6/1989 Wexler ..... 273/330
D324,114 S * 2/1992 Batrick et al. ..... D21/444
5,120,051 A 6/1992 Greenberg
5,295,269 A * 3/1994 Ballard ..... 2/18
5,669,837 A * 9/1997 Hauter ..... 473/576
6,142,889 A * 11/2000 Schaubach ..... 473/426
(Continued)

*Primary Examiner* — Shelley Self
*Assistant Examiner* — Richale Quinn
(74) *Attorney, Agent, or Firm* — Robert M. Downey, P.A.

(57) ABSTRACT

An exercise device includes a left glove member adapted to be worn on the left hand of a user and a right glove member adapted to be worn on the right hand of the user, the left and right glove members each having an impact area and an elastomeric cord extending from a center of the impact area to a ball, such that the ball is connected to the left and right glove members by the elastomeric cords of equal length. A rigid plate member is fitted within each of the left and right glove members for providing a solid surface at the impact area. The user, wearing the left and right glove members, alternates movement of the hands in a repeated left and right punch throwing action which causes the ball to alternately strike the impact areas of the glove members and travel away from the user until the elastomeric cord leading from the opposite hand stretches taut and causes the ball to travel back towards the user for subsequent striking with the opposite hand. This alternating action is repeated for as many punches as the user can continue to hit the ball.

3 Claims, 8 Drawing Sheets

U.S. PATENT DOCUMENTS

| | | | | |
|---|---|---|---|---|
| 7,043,763 | B2 * | 5/2006 | Carrillo | 2/18 |
| 2003/0211905 | A1 * | 11/2003 | Miller | 473/424 |
| 2005/0014580 | A1 * | 1/2005 | Silman et al. | 473/424 |
| 2008/0176680 | A1 * | 7/2008 | Abel et al. | 473/508 |
| 2010/0257651 | A1 * | 10/2010 | Anderson et al. | 2/18 |
| 2011/0088131 | A1 * | 4/2011 | Mcvan | 2/18 |

* cited by examiner

BOXING EXERCISE DEVICE

FIELD OF THE INVENTION

The present invention relates to exercise devices and, more particularly, to a boxing exercise device including two glove members and a ball that is connected to the glove members by an elastomeric cord(s), wherein the ball is punched with the glove members in an alternating action.

DISCUSSION OF THE RELATED ART

The health and fitness industry is crowded with many types of exercise devices for strengthening and toning various muscles in the body and/or for providing an aerobic workout. Use of many exercise devices often involves a repetitive action that quickly becomes mundane to the user. The lack of enjoyment while using these devices tends to discourage long term use. Accordingly, many consumers purchase exercise devices with initial enthusiasm, but discontinue use of the device after only a few exercise sessions.

While some exercise devices are associated with a certain sport or activity, such as cycling (e.g., a stationary bike), cross country skiing, running or rowing, there are a large number of exercise devices that have no association to a particular sport or activity. This tends to make these devices even more boring to use over an extended period of time. Accordingly, there is a need for an exercise device that is fun and challenging to the user. There is a particular need for a safe, fun and low impact exercise device relating to the field of boxing that can be used by males and females of all ages.

The present invention addresses the particular need for a boxing exercise device that is fun to use by men, women and children and which provides an excellent cardiovascular workout, while perfecting hand and eye coordination and strengthening the muscles of the upper body.

Objects and Advantages of the Invention

Considering the foregoing, it is a primary object of the present invention to provide an exercise device that is particularly related to the sport of boxing and which provides an excellent cardiovascular workout.

It is a further object of the present invention to provide a boxing exercise device that helps to perfect hand and eye coordination of the user.

It is still a further object of the present invention to provide a boxing exercise device that provides a full body workout, and particularly the upper body, chest, back, shoulders and arms.

It is still a further object of the present invention to provide a boxing exercise device that requires some skill and that invites competition among multiple users during an exercise session.

It is yet a further object of the present invention to provide a boxing exercise device that uses a pair of boxing gloves and a ball attached to each of the gloves by an elastomeric cord.

It is still a further object of the present invention to provide a boxing exercise device that takes advantage of the novelty of the use of boxing gloves, thereby enhancing the marketability of the invention to both male and female consumers of all ages.

It is still a further object of the present invention to provide a boxing exercise device that is relatively inexpensive, requires no installation or assembly, and which is relatively easy to use.

It is still a further object of the present invention to provide a boxing exercise device that is compact and convenient to pack in one's suitcase when traveling, thereby allowing the user to enjoy workouts using the device while away from home.

These and other objects and advantages of the present invention are readily apparent with reference to the detailed description and accompanying drawings.

SUMMARY OF THE INVENTION

The present invention is directed to an exercise device that includes a left glove member adapted to be worn on the left hand of a user and a right glove member adapted to be worn on the right hand of the user. The left and right glove members each have an impact area and an elastomeric cord extending from a center of the impact area to a ball, such that the ball is connected to the left and right glove members by the elastomeric cords of equal length. A rigid plate member is fitted within each of the left and right glove members for providing a solid surface at the impact area. The user, wearing the left and right glove members, alternates movement of the hands in a repeated left and right punch throwing action. This causes the ball to alternately strike the impact areas of the glove members and travel away from the user until the elastomeric cord leading from the opposite hand stretches taut and causes the ball to travel back towards the user, in a reciprocating action, for striking with the opposite hand. The user continues to throw alternating left and right punches for as many times as he or she can consecutively hit the ball.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
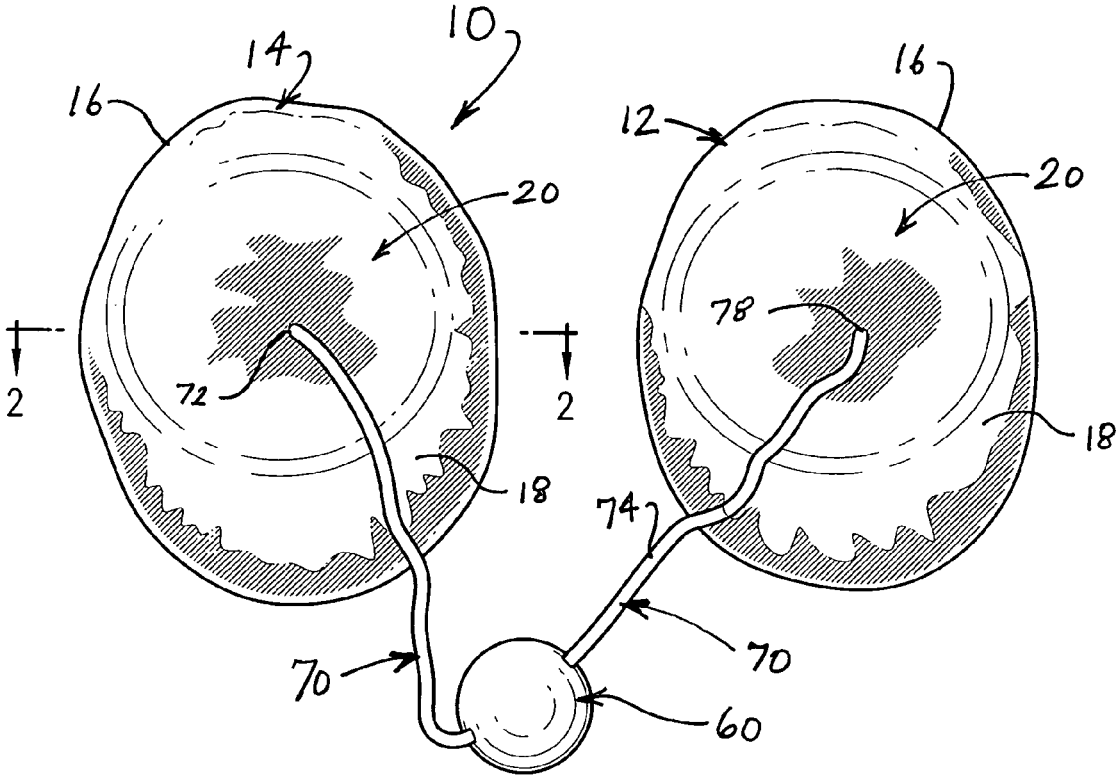
FIG. 1 is a front elevational view of the exercise device of the present invention showing a left glove component, a right glove component and a ball interconnected to impact areas of each of the left and right glove components by an elastomeric cord.
Figure 2:
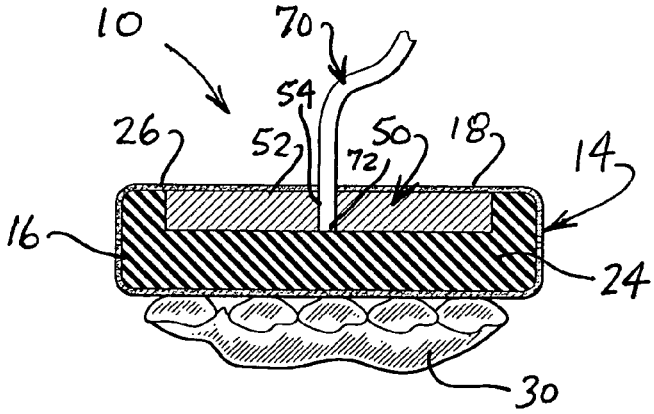
FIG. 2 is a cross sectional view taken along the plane of the line indicated as 2-2 in FIG. 1.
Figure 3:
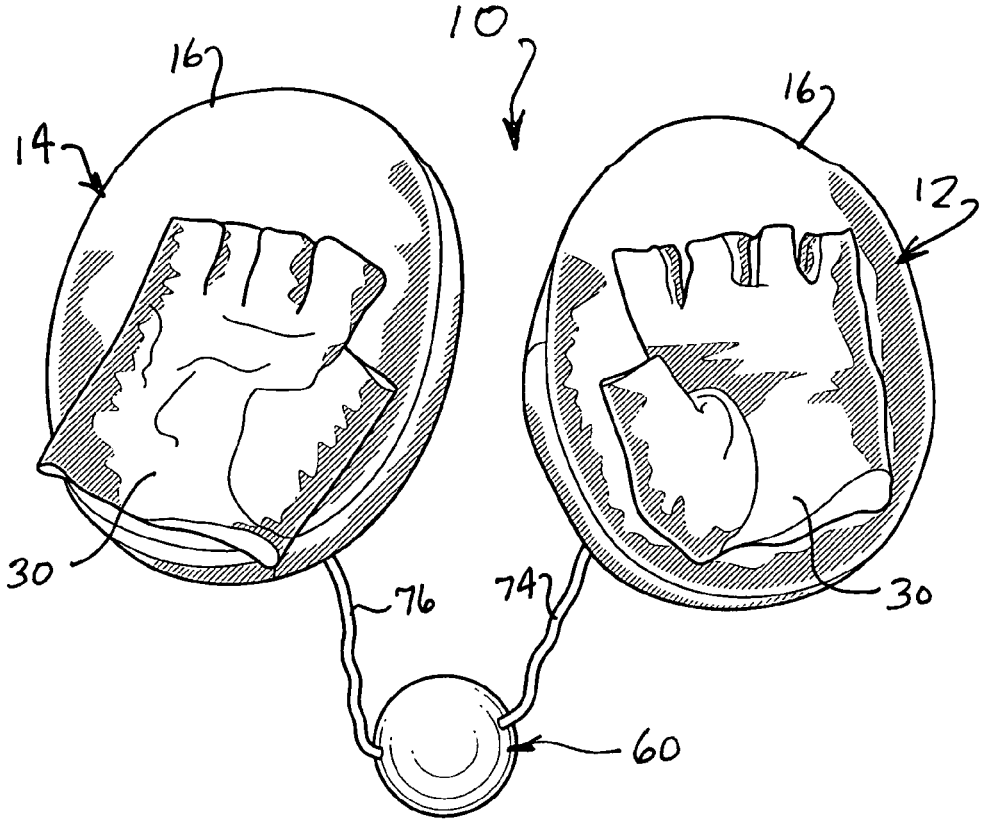
FIG. 3 is a rear perspective view of the exercise device of FIG. 1.

Referring to the several views of the drawings, and initially FIGS. 1-3, the boxing exercise device is shown and is generally indicated as 10. The boxing exercise device 10 includes a left glove component 12 and a right glove component 14. The left glove component 12 is adapted to be worn on the left hand of the user, while the right glove component 14 is adapted to be worn on the right hand of the user. In each of the embodiments of the invention, the left and right glove components each include an impact area 20, as indicated by the circles on the left and right glove components in FIGS. 1 and 4. This impact area 20 is generally the area of a boxing glove that would normally strike an opponent boxer or punching bag when a user wearing boxing gloves throws left and right punches with the fists closed.

In the embodiment of FIGS. 1-3, the left and right glove components 12, 14 each include an enlarged pad 16 similar to the type used as sparring pads for blocking punches of a boxer during training. The pads 16 of the left and right glove components have an inner foam rubber core 24 that is surrounded by an exterior casing or shell 26. The outer casing 26 may be made of leather, plastic, vinyl or other suitable material. A front face 18 of each pad 16 includes the impact areas 20 as seen in FIG. 1.

Figure 5:
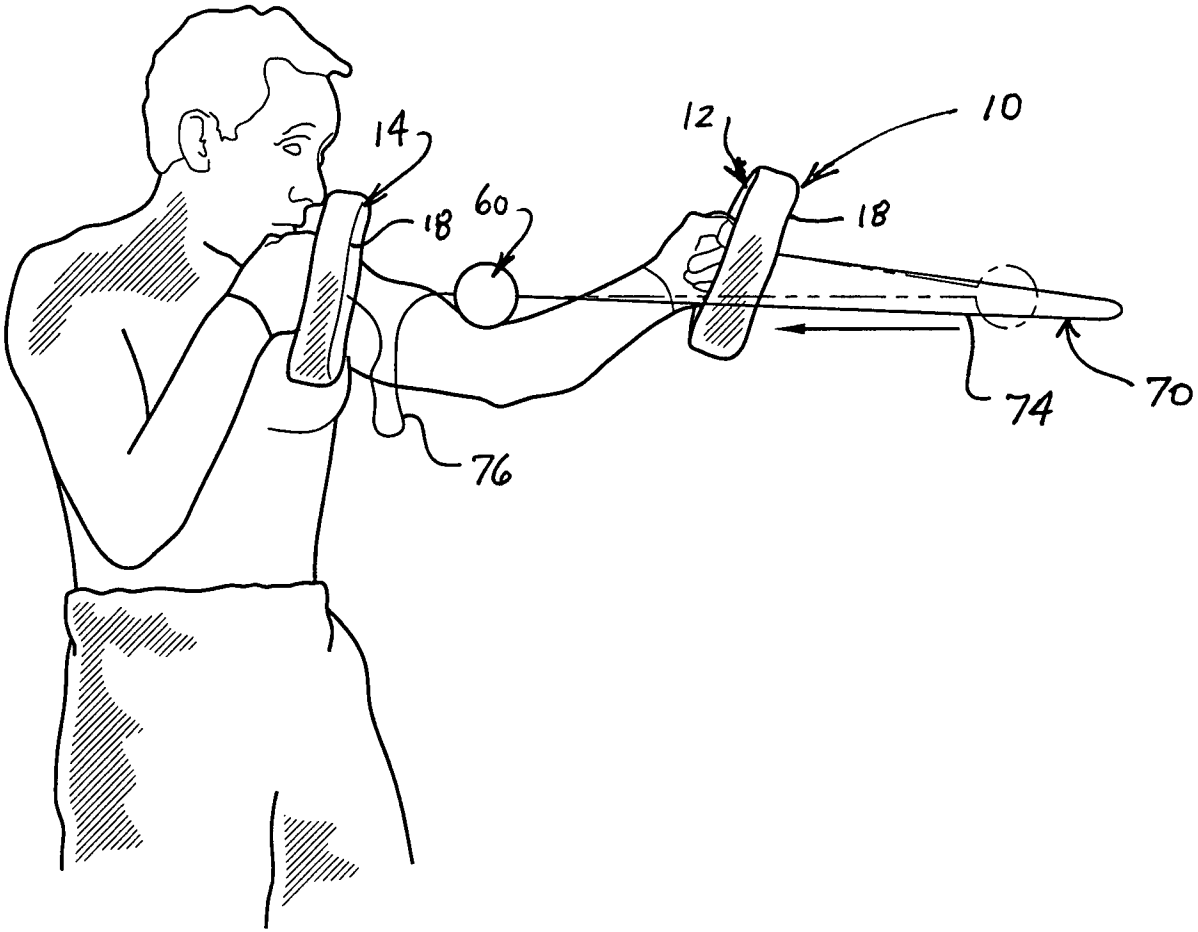
FIGS. 5-7 present perspective views of a person using the boxing exercise device of FIG. 1 and illustrate a sequence of operation wherein the person using the boxing exercise device throws alternating left and right punches which causes the ball to alternately strike the left glove component and then the right glove component, as the ball moves away from the user and then comes back toward the user in a reciprocating action after each punching strike of the ball.
Figure 6:
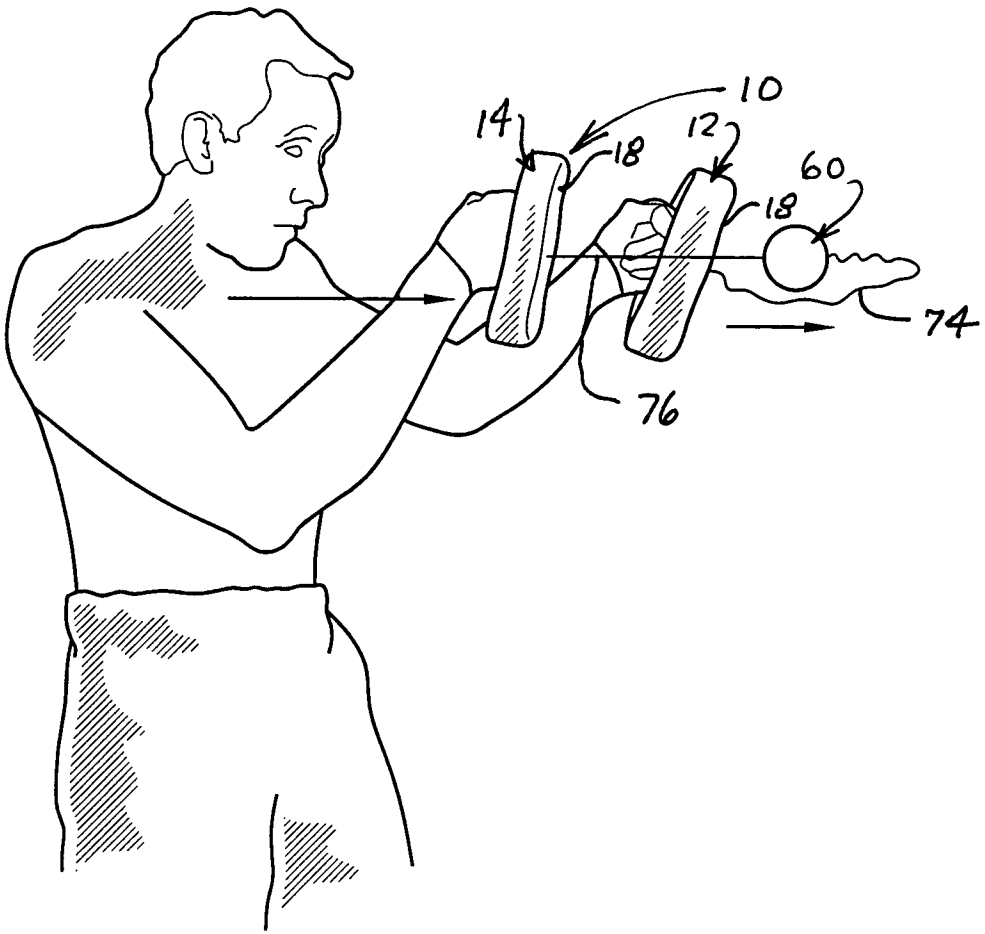
Figure 7:
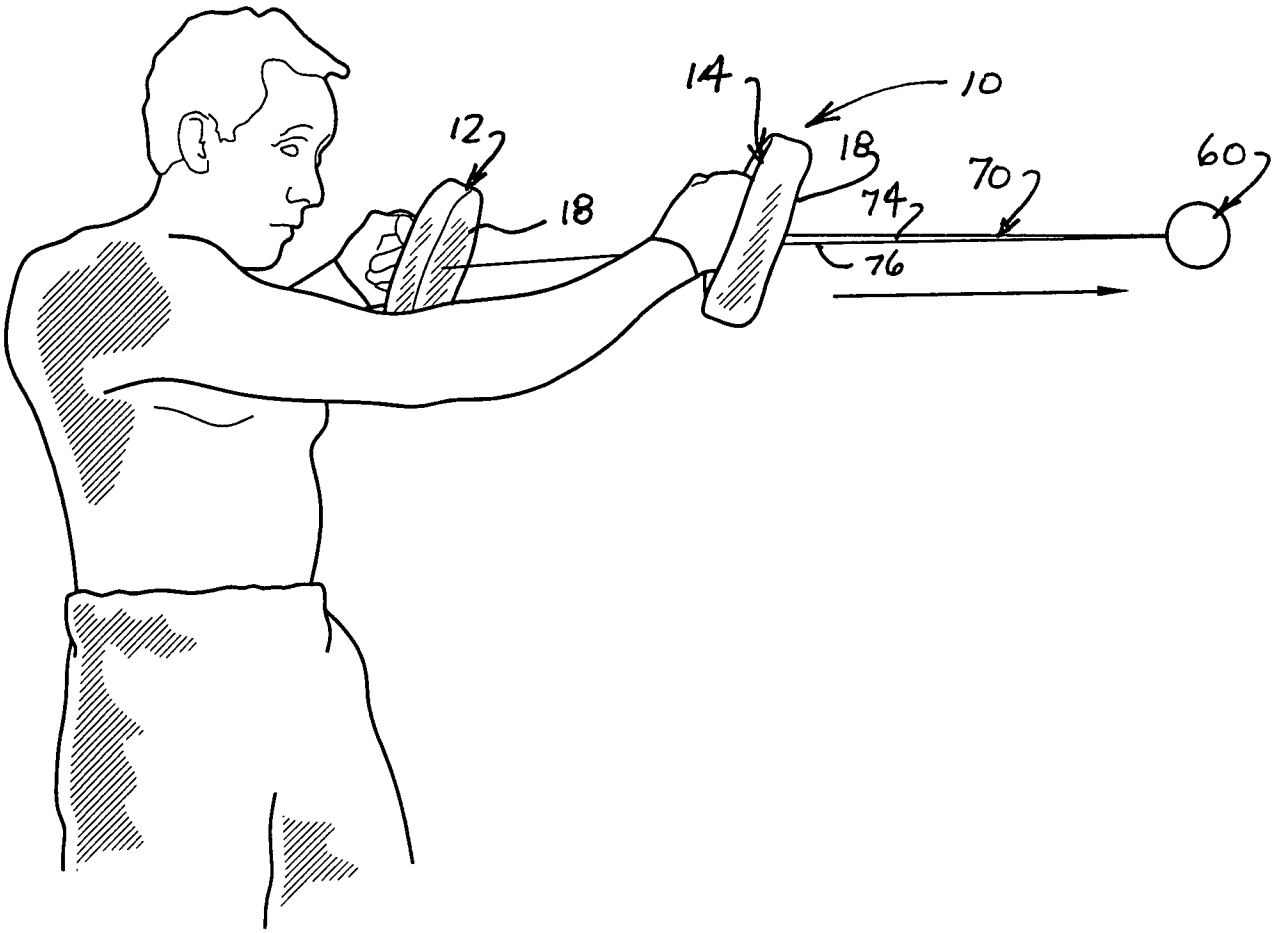
Figure 8:
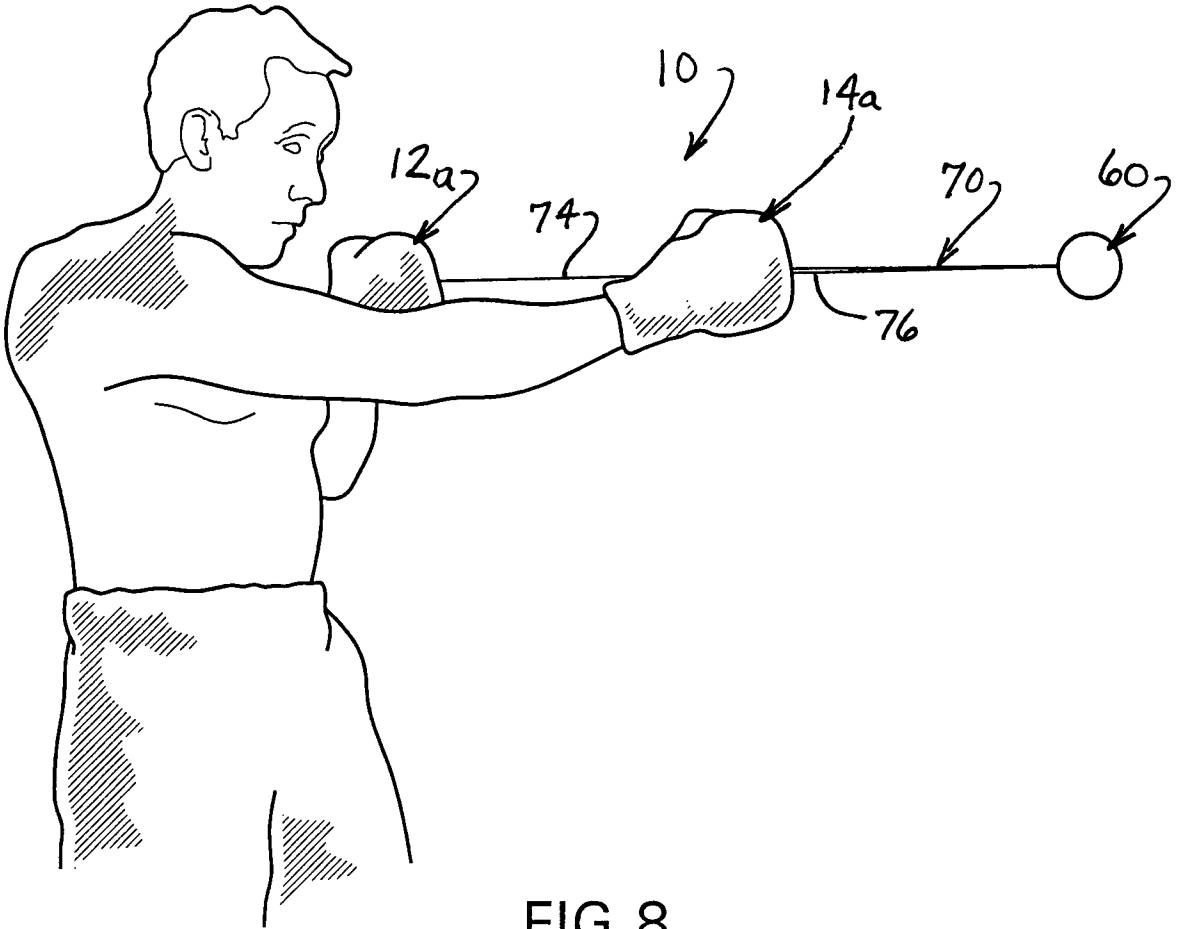
FIG. 8 is a perspective view similar to that shown in FIGS. 5-7, showing a person using the boxing exercise device in accordance with the preferred embodiment of FIG. 4, wherein the left and right glove components resemble boxing gloves.
Figure 9:
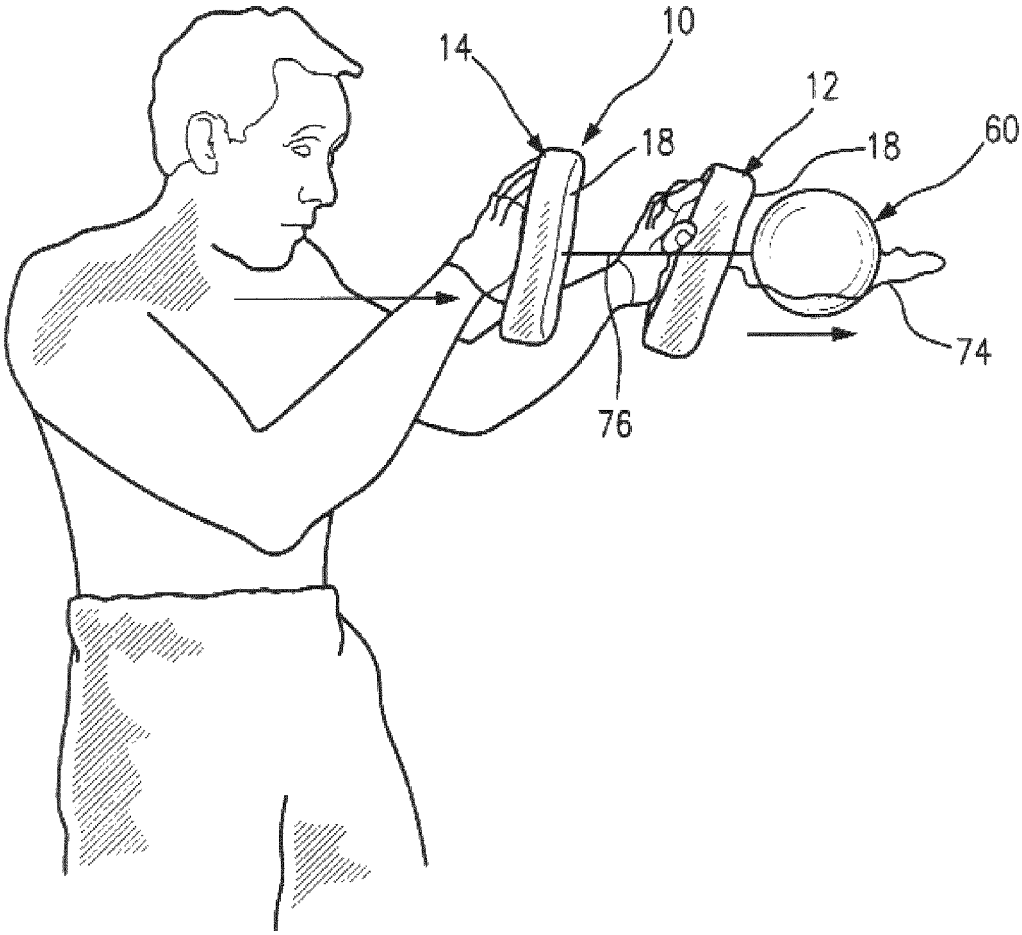
FIGS. 9-10 present perspective views of a person using the boxing device of FIG. 1 with one or both hands received within the gloves so that the palm of either or both hands faces towards the pads.
Figure 10:
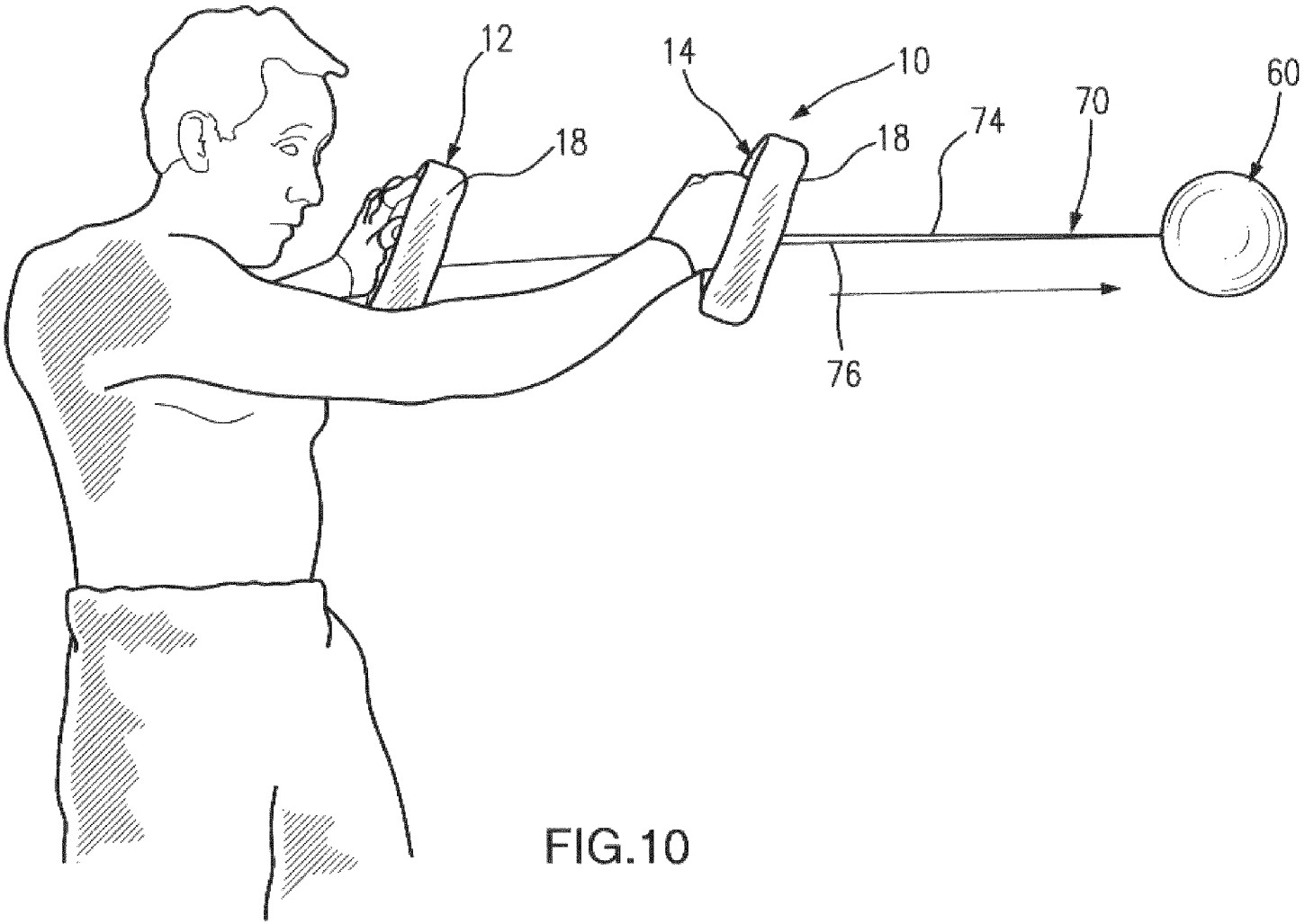

The embodiment of FIGS. 1-3 further includes left and right gloves 30 on each of the corresponding left and right glove components 12, 14. The gloves 30 are adapted for receipt of the user's left and right hands with the palms of the hands facing away from the pads 16. The fingers of the gloves 30 are open to allow the user to easily make a first so that the impact areas 20 of the left and right glove components 12, 14 face away from the user when in a boxing stance, as shown in FIGS. 5-7. The gloves 30 are attached to the outer casing 26 of the pads 16 and are able to close with the user's first without resistance, while the pads retain their normal configuration, as seen in the drawings. FIGS. 9 and 10 show further examples of how the user's hands may be inserted within the gloves 30 so that the palm of either or both hands faces towards the pads 16. In FIG. 9, the user is wearing the gloves 30 so that the palms of both the left and right hands face towards the pads. In FIG. 10, the user is wearing the gloves so that the right hand is received within the glove with the palm facing away from the pad 16 and the left hand is received within the glove so that the palm faces toward the pad.

Figure 4:
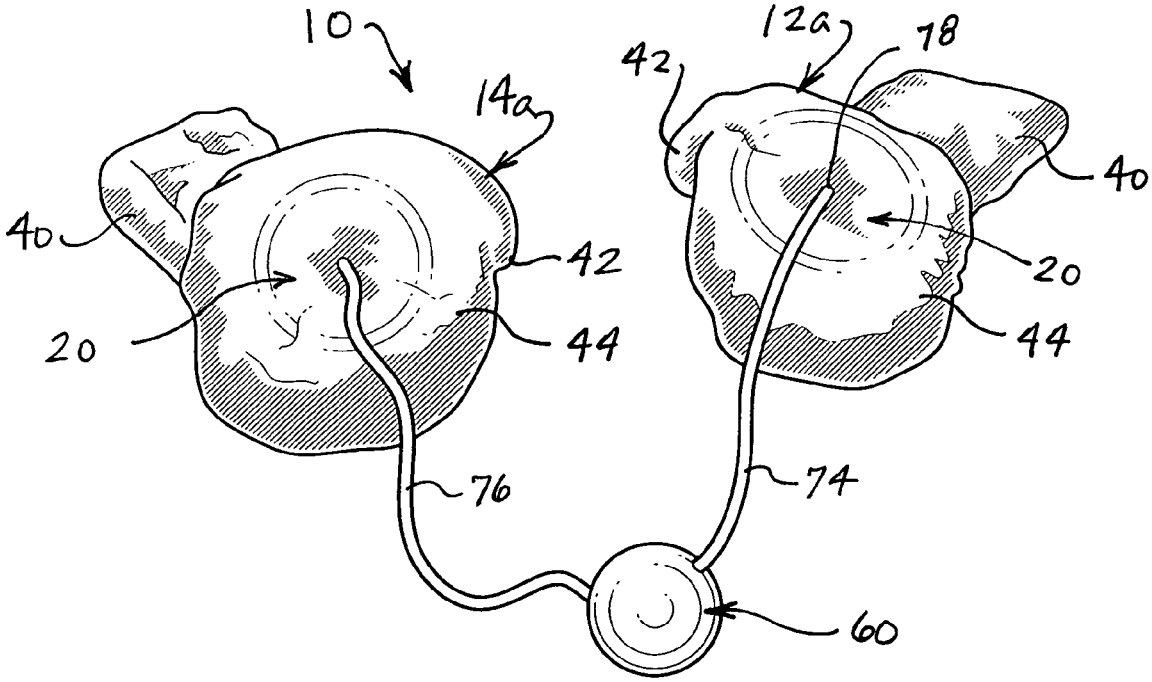
FIG. 4 is a front perspective view of the boxing exercise device of the present invention, in accordance with a preferred embodiment, wherein the left and right glove components resemble boxing gloves in both construction and appearance.

FIG. 4 illustrates a preferred embodiment of the left and right glove components, indicated as 12*a* and 14*a*. Specifically, the left and right glove components 12*a* and 14*a* are constructed to resemble boxing gloves of the type that are worn by amateur and professional boxers in the ring during a fight. Specifically, each of the left and right glove components 12*a* and 14*a* includes a wrist and forearm portion 40, a thumb portion 42 and a fist portion 44 that includes the impact area 20 as indicated by the circles in FIG. 4. The fist portion 44 is filled with a fibrous material, foam rubber or other cushioning core material.

In each of the embodiments shown in FIGS. 1-4, a rigid plate member 50 is fitted within each of the left and right glove components 12, 14, in confronting relation to the impact area 20 on the outer facing side of the glove components. As shown in FIG. 2, the rigid plate member 50 is recessed within the foam rubber core 24 or other core material of the glove components so that a flat, hard face 52 of the rigid plate member 50 is disposed directly behind the outer casing of the glove components and within the impact area 20. The rigid plate member 50 reinforces the impact area 20 and the flat face 52 provides a hard surface which enhances the degree of bounce of a ball striking the impact area 20, as described hereinafter.

In each of the embodiments, as shown throughout the several views of the drawings, the boxing exercise device 10 includes a ball 60. In a preferred embodiment, the ball 60 is constructed of a resilient material that possesses very good bounce characteristics, similar to that of a conventional racquetball or tennis ball. In a preferred embodiment, the ball 60 is of a size generally in a range between a conventional racquetball and a tennis ball. An elastomeric cord (e.g., a rubber cord) 70 connects to each of the left and right glove components and the ball 60. Specifically, a first end 72 of the elastomeric cord 70 is anchored within the glove component and passes through a central hole 54 in the rigid plate member 50 and outwardly through the outer casing of the left glove component within the center of the impact area, as best seen in FIG. 1. The elastomeric cord 70 extends from the left glove component 12 a distance of approximately 12 to 30 inches and then passes through the ball 60, forming a first leg 74 of the elastomeric cord 70. The exact length of this first leg may vary and is not limited to the range of 12 to 30 inches. The elastomeric cord 70 exits the ball and extends back to the right glove component 14 defining the second leg 76 of the elastomeric cord 70 that is approximately equal in length to the first leg. The second leg 76 of the elastomeric cord 70 passes through the center of the impact area 20 of the right glove component 14 (i.e., through the outer casing) and through a central hole 54 of the rigid plate member 50 therein. The end 78 of the second leg 76 (i.e., the opposite end of the elastomeric cord) is anchored within the right glove component 14, behind the rigid plate member 50. Both the opposite ends 72, 78 of the elastomeric cord 70 may be anchored within the respective left and right glove components by forming a knot at the ends of the elastomeric cord, preventing the cord from passing through the central hole 54 of the rigid plate members 50. Alternatively, an enlarged object may be secured to the opposite ends 72, 78 of the elastomeric cord 70, behind the rigid plate members 50, preventing the opposite ends of the elastomeric cord from being pulled through the central hole 54 of the rigid plate members and out from the respective left and right glove components.

In an alternative embodiment, two individual elastomeric cords may be used, each extending from one of the left and right glove components, anchored therein as described above, and individually attached to the ball. The individual elastomeric cords would thus define the first and second legs 74, 76 which are of approximately equal length.

FIGS. 5-7 illustrate the manner of use of the boxing exercise device 10 of the present invention. As seen, the user, wearing the left and right glove components 12, 14 assumes a boxing stance and begins by lightly tossing the ball 60 in front of either of the left or right glove components and then throwing a punch straight out and away from the user so that the impact area of the glove component strikes the ball and causes the ball to travel horizontally away from the user. As the ball 60 travels away from the user, the leg 74 or 76 of the elastomeric cord 70 connecting between the ball 60 and the glove component 12 or 14 that struck the ball stretches and becomes taut. The energy in the stretched elastomeric cord slows the ball in its direction away from the user and then urges the ball back toward the user, in the opposite direction and generally along a horizontal plane. As the ball 60 approaches within an approximate distance of 10-15 inches in front of the user, the user strikes the ball with the opposite glove component, again causing the ball to hit the impact area 20 of that glove component and bounce away from the user along a general horizontal plane. The respective leg 74 or 76 of the elastomeric cord 70 will again stretch and eventually pull the ball 60 back toward the user for a subsequent strike with the opposite hand. The user continues to throw left and right punches causing the ball 60 to alternately strike the impact areas of the left and right glove members and travel away from the user until the elastomeric cord stretches taut and causes the ball to travel back to the user, in a reciprocating action, for striking with the opposite hand. The user continues to throw alternating left and right punches for as many times as he/she can consecutively hit the ball.

Several users of the boxing exercise device may compete as they each try to achieve the highest number of consecutive hits of the ball.

The action of using the boxing exercise device 10, as described above, provides an excellent cardiovascular workout using the entire body, and particularly strengthening and toning the upper body, chest, back, shoulders and arms, while also improving hand and eye coordination of the user.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. An exercise device comprising:

a left glove member adapted to be worn on a left hand of a user and a right glove member adapted to be worn on a right hand of the user;

said left and right glove members each including an outer casing formed and configured to include a wrist portion and a hand receiving portion including a palm side with a palm covering portion and an opposite dorsal side with a first covering portion, a cushioning core material under said outer casing on said dorsal side, and said hand receiving portion being structured and disposed for receiving a user's hand between said cushioning core material and said palm covering portion, an impact zone at a distal end of said dorsal side, and said impact zone normally presented away from the user when the user, wearing said left and right glove members, makes a fist with the left and right hands while holding the arms in a boxing stance;

a ball possessing bounce characteristics and adapted to bounce away from said impact zone as a result of forced impact with said impact zone;

a first leg of an elastomeric cord extending and connecting between said left glove member and said ball and including a distal end anchored to said dorsal side and extending from said impact zone of said left glove member and a second leg of an elastomeric cord extending and connecting between said right glove member and said ball and including a distal end anchored to said dorsal side and extending from said impact zone of said right glove member; and whereby the user, while wearing said left and right glove members throws left and right punches, in alternating sequence, causing said ball to strike said impact zone on said dorsal side of one of said left and right glove members and then bounce in a direction away from the user until one of said first and second legs of the elastomeric cord is stretched taut and urges the ball back towards the user as the user throws a punch with the opposite hand to cause the ball to strike the impact zone on said dorsal side of the other of said left and right glove members in an alternating sequence.

2. The exercise device as recited in claim 1 wherein said first leg and said second leg of said elastomeric cord are independent of one another.

3. The exercise device as recited in claim 1 wherein said first leg and said second leg of said elastomeric cord are sections of a continuous length of the elastomeric cord attached to both said left and right glove members and said ball.

* * * * *